US009617835B2

(12) United States Patent
Ferguson et al.

(10) Patent No.: US 9,617,835 B2
(45) Date of Patent: Apr. 11, 2017

(54) BARRIER FOR A DOWNHOLE TOOL

(71) Applicant: Weatherford Technology Holdings, LLC, Houston, TX (US)

(72) Inventors: Patrick David Ferguson, White Oak, TX (US); Mark Gerald Miller, Gladewater, TX (US); John Edward Stachowiak, Jr., Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 394 days.

(21) Appl. No.: 14/209,920

(22) Filed: Mar. 13, 2014

(65) Prior Publication Data

US 2014/0262206 A1 Sep. 18, 2014

Related U.S. Application Data

(60) Provisional application No. 61/792,317, filed on Mar. 15, 2013.

(51) Int. Cl.
*E21B 43/08* (2006.01)
*E21B 43/12* (2006.01)

(52) U.S. Cl.
CPC ..... *E21B 43/084* (2013.01); *E21B 43/121* (2013.01)

(58) Field of Classification Search
USPC ..... 166/105.1, 230
See application file for complete search history.

(56) References Cited

U.S. PATENT DOCUMENTS 4,141,413 A * 2/1979 Morris ..... E21B 33/1295 166/120
4,428,592 A * 1/1984 Shaffer ..... E21B 33/06 251/1.2
4,441,721 A * 4/1984 Harris ..... E21B 33/1208 277/342
5,361,834 A * 11/1994 Cox ..... E21B 23/06 166/120
5,778,982 A * 7/1998 Hauck ..... E21B 33/1277 166/187
6,896,052 B2 5/2005 Simpson et al.
7,686,598 B2 3/2010 Williams
2002/0092654 A1* 7/2002 Coronado ..... E21B 33/1208 166/369
2003/0034159 A1* 2/2003 Weinig ..... E21B 33/1293 166/120
2005/0230100 A1* 10/2005 Hirth ..... E21B 33/12 166/120
2007/0051517 A1* 3/2007 Surjaatmadja ..... E21B 33/127 166/308.1
2007/0144734 A1* 6/2007 Xu ..... E21B 33/1216 166/187

(Continued)

OTHER PUBLICATIONS

Canadian Office Action dated May 10, 2016, for Canadian Patent Application No. 2,847,002.

*Primary Examiner* — Taras P Bemko
(74) *Attorney, Agent, or Firm* — Patterson & Sheridan, LLP

(57) ABSTRACT

A barrier assembly for use with a downhole pump includes a first tubular adapter, a second tubular adapter, and a braided sleeve disposed between the first tubular adapter and the second tubular adapter. The sleeve is configured to block passage of a particulate.

20 Claims, 8 Drawing Sheets

(56) References Cited

U.S. PATENT DOCUMENTS

| | | | | |
|---|---|---|---|---|
| 2009/0071641 | A1* | 3/2009 | Gaudette | E21B 33/00 166/118 |
| 2009/0169397 | A1* | 7/2009 | Parr | E21B 43/124 417/54 |
| 2011/0070099 | A1* | 3/2011 | Schlenhoff | F04D 29/047 417/53 |
| 2011/0214880 | A1* | 9/2011 | Rogers | E21B 43/00 166/372 |

* cited by examiner

BARRIER FOR A DOWNHOLE TOOL

BACKGROUND OF THE INVENTION

Field of the Invention

The present invention generally relates to a barrier for use with a downhole tool. More particularly, the invention relates to an expandable mesh barrier for use with a downhole pump.

Description of the Related Art

When an oil well is first drilled and completed, the fluids (such as crude oil) may be under natural pressure that is sufficient to produce on its own. Over time, the natural pressure may decline to the point where the oil must be artificially lifted to the surface. A rod pump may be used to artificially lift the oil to the surface. A string of sucker rods extends down to a pump located downhole and is reciprocated to operate the pump.

One issue encountered during use of the rod pump is that particulates (sand, iron oxides, etc) entrained in a producing fluid may settle down in the annular area between the barrel of the pump and the tubing. As the particulates build up to several feet in height, they will "pack" into this annular area and cause the pump barrel to become stuck in the tubing.

There are devices available in the industry designed to address this issue. For example, a "top seal" can be installed onto the top of the pump barrel to prevent particulates from falling into the annular region between the barrel and the tubing. One such prior art design of a top seal incorporates a rubber "finned" element that consists a number of radially protruding rubber disks or fins. With this type of design, the fins may become brittle due to excessive heat or the fins may become weak due to excessive flexural fatigue when travelling down the wellbore. This may result in the fins parting from the top seal assembly and falling down into the wellbore.

There is a need, therefore, for an improved mechanism that could effectively prevent particulates from accumulating between the barrel and the tubing.

SUMMARY OF THE INVENTION

In one embodiment, a pump assembly includes a barrel; a plunger; a rod for operating the plunger; and a barrier assembly having a mesh sleeve configured to block passage of a particulate.

In another embodiment, a barrier assembly for use with a downhole pump includes a first tubular adapter; a second tubular adapter; a sleeve having a plurality of weave members and disposed between the first tubular adapter and the second tubular adapter, wherein the sleeve is configured to block passage of a particulate.

In another embodiment, a pump assembly includes a guide; a barrel; a plunger; a rod for operating the plunger; and a barrier assembly. The barrier assembly includes a top adapter attached to the guide; a bottom adapter attached to the barrel; and a mesh sleeve disposed between the top adapter and the bottom adapter, wherein the mesh sleeve is configured to block passage of a particulate.

In another embodiment, a barrier assembly includes a first tubular adapter; a second tubular adapter; and a sleeve having a plurality of weave members and is disposed between the first tubular adapter and the second tubular adapter, wherein the sleeve is expandable in response to a compressive force.

In one or more of the embodiments described herein, the mesh sleeve includes a plurality of weave members configured to block passage of a particulate.

In one or more of the embodiments described herein, the mesh sleeve is expandable.

In one or more of the embodiments described herein, the mesh sleeve allows fluid communication.

In one or more of the embodiments described herein, the sleeve is extendable in response to tension.

In one or more of the embodiments described herein, the sleeve is expandable in response to compression.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE PREFERRED EMBODIMENT

Embodiments of the present invention generally relates to a barrier assembly for a downhole pump. In one embodiment, the barrier assembly includes a braided sleeve configured to block passage of a particulate.

Figure 1:
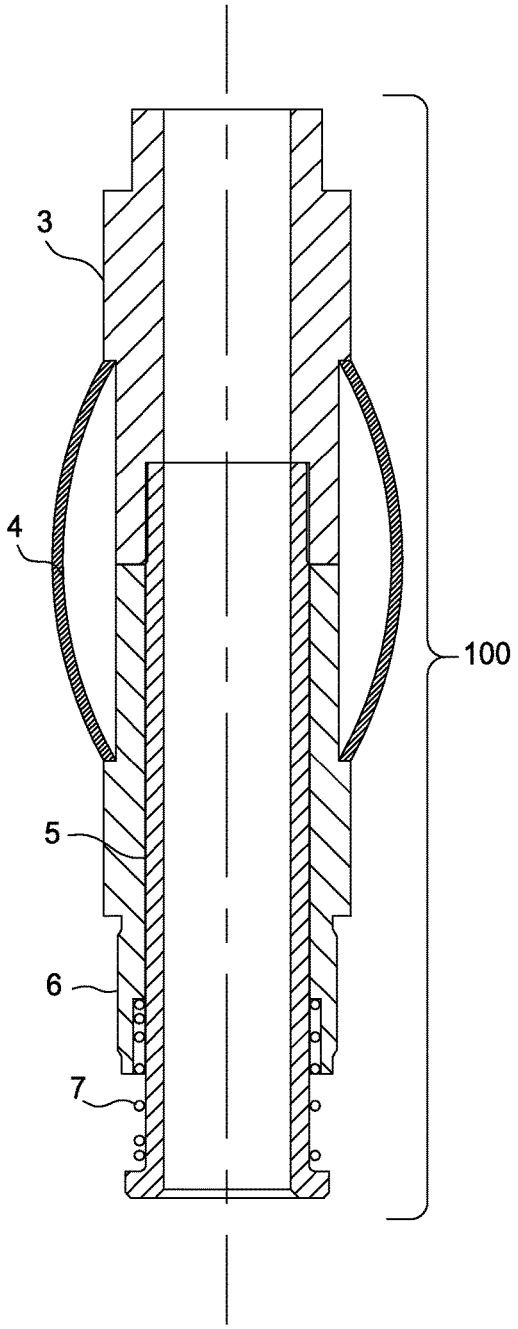
FIG. 1 illustrates an exemplary embodiment of a barrier assembly.
Figure 3:
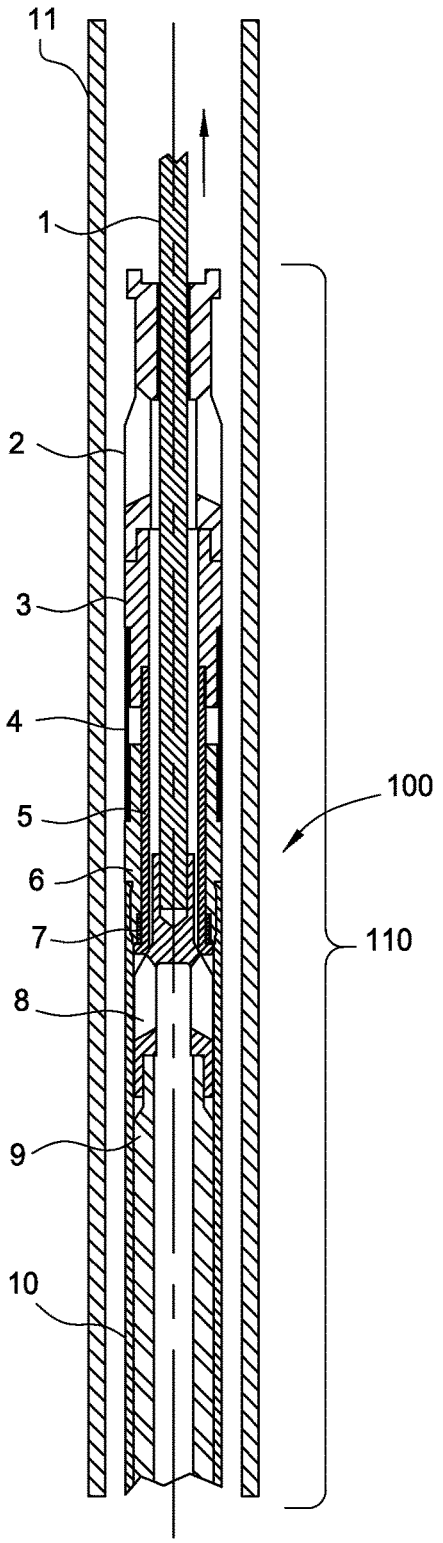
FIG. 3 illustrates an exemplary embodiment of a pump equipped with the barrier assembly of FIG. 1.

FIG. 1 illustrates an exemplary embodiment of a barrier assembly 100. The barrier assembly 100 may be used with a downhole pump 110 as shown in FIG. 3. The barrier assembly 100 includes a top adapter 3 connected to an actuating sleeve 5. A bottom adapter 6 is slidably coupled to the outer surface of the actuating sleeve 5. A mesh sleeve 4 is connected between the top adapter 3 and the bottom adapter 6. A biasing member 7 such as a spring may be used to bias the bottom adapter 6 toward the top adapter 3.

Figure 5:
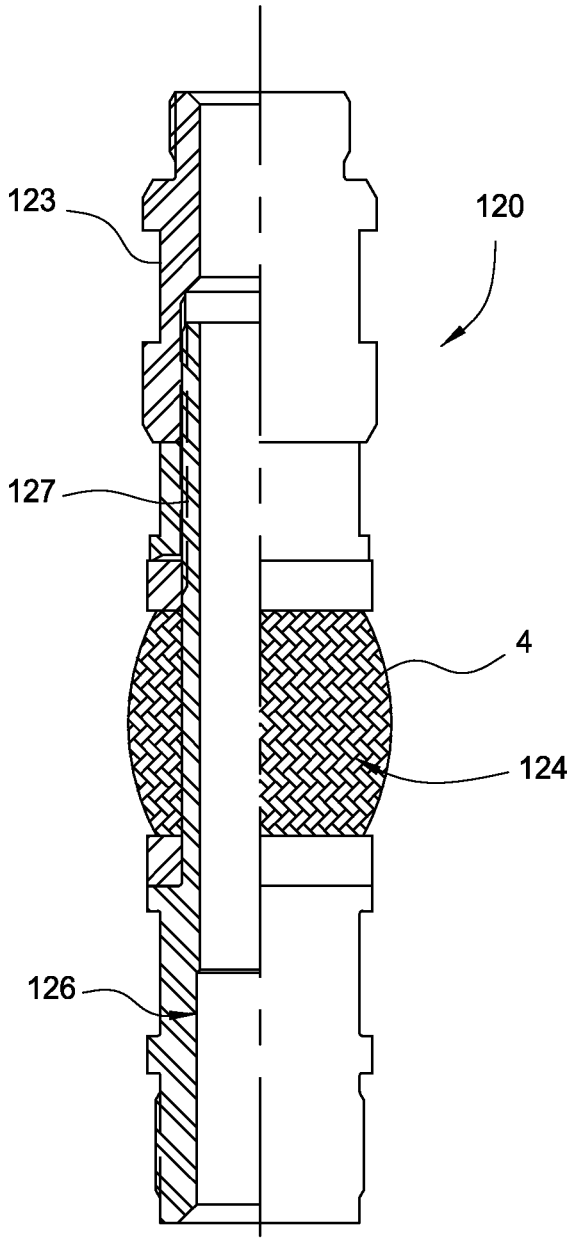
FIG. 5 illustrates another embodiment of a barrier assembly.

In one embodiment, the mesh sleeve 4 has a weave configuration formed by intertwining a plurality of weave members 124, for example, as shown in FIG. 5. The weave configuration allows the sleeve 4 to increase its outer diameter when placed in axial compression and to decrease its outer diameter when placed in axial tension. Also, the weave configuration allows the sleeve 4 to become longer when radially compressed and to become shorter when radially expanded. The spacing between the mesh members can be any suitable size so long as the spacing effectively blocks particulates from passing through the sleeve 4. In this respect, the sleeve 4 acts like a barrier. An exemplary mesh sleeve 4 is a braided sleeve. In another embodiment, the mesh sleeve 4 is a knitted sleeve. The weave members 124 forming the weave configuration may be made of, but not limited to, steel, polymer, plastic, rubber, and combinations thereof. An exemplary weave configuration is a braided configuration. In another embodiment, the mesh sleeve 4 may be configured to also block the flow of fluid, and thereby acting as a seal. In another embodiment, one or more weave members may be coated with a low friction material including but not limited to polytetrafluoroethylene such as Teflon® and a fullerene such as bucky-ball.

Figure 2:
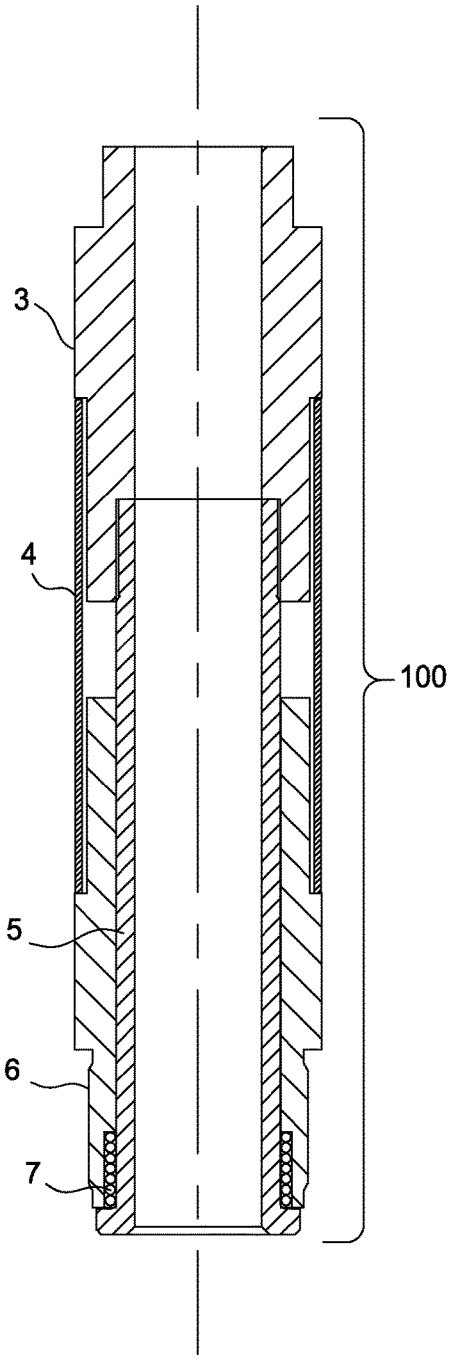
FIG. 2 shows the barrier assembly of FIG. 1 in an unexpanded position.

The barrier assembly 100 is configured to alter the outer diameter of the mesh sleeve 4 depending on the relative positions of the bottom adapter 6 and the top adapter 3. FIG. 1 shows the barrier assembly 100 in an expanded position. In this position, the bottom adapter 6 is biased toward the top adapter 3 using the spring. As a result, the bottom adapter 6 applies a compressive force against the sleeve 4. In turn, the length of the sleeve 4 is reduced and the sleeve 4 is expanded outward, thereby increasing its outer diameter. FIG. 2 shows the barrier assembly 100 in an unexpanded position. In this position, the bottom adapter 6 has been urged downward, thereby compressing the spring 7. As a result, the bottom adapter 6 has moved away from the top adapter 3, thus lengthening the distance therebetween. In turn, the sleeve 4 becomes longer and has a smaller outer diameter.

FIG. 3 illustrates an exemplary embodiment of a rod pump 110 equipped with a barrier assembly 100. The rod pump 110 is shown disposed in a tubing 11, which is disposed in a well. The pump 110 includes a guide 2 coupled to the pump barrel 10 using the barrier assembly 100. The upper portion of the top adapter 3 is attached to the guide 2, and the lower portion of the bottom adapter 6 is attached to the pump barrel 10. A rod 1 extends from the surface and through the guide 2 into the barrel 10. The lower end of the rod 1 is coupled to a plunger 9 using a coupling 8.

As the pump 110 is lowered down the tubing 11 by the rod 1, the plunger 9 is at the upper most position with respect to the barrel 10. Consequently, the plunger coupling 8 is in contact with the actuating sleeve 5. The pump barrel 10, which is coupled to the bottom adapter 6, is urged downward by gravity. The downward force of the barrel 10 compresses the spring 7, thereby maintaining the bottom adapter 6 away from the top adapter 3. In turn, the length of the sleeve 4 is extended and the outer diameter of sleeve 4 is reduced. In one embodiment, the sleeve 4 has an unexpanded outer diameter that is the same or smaller than the outer diameter of the barrel 10. In the unexpanded state, the mesh sleeve 4 will not incur frictional wear against the inner tubing wall as the pump 110 travels down the tubing string 11.

Figure 4:
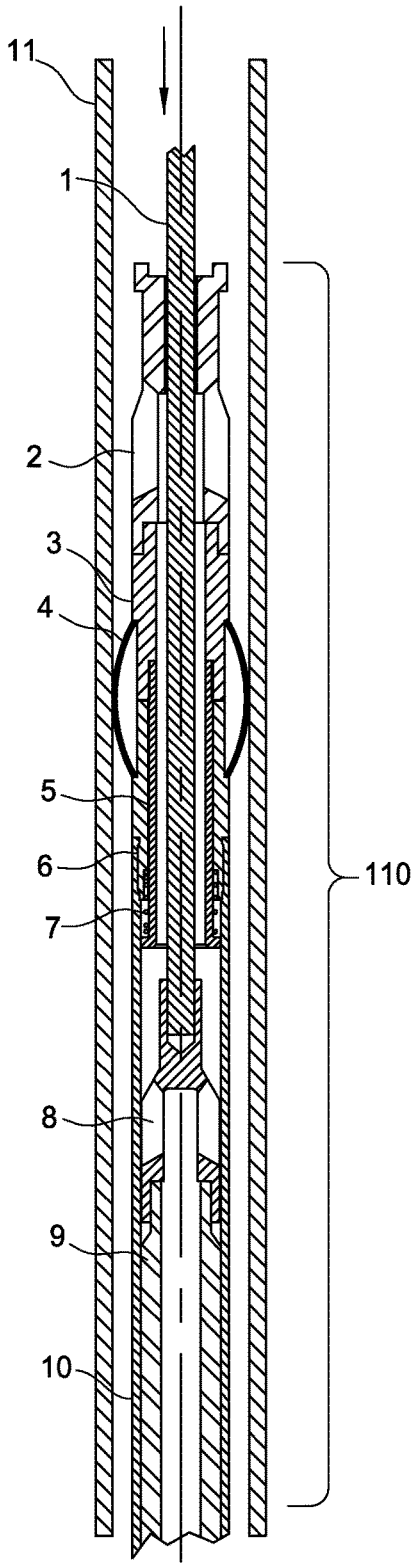
FIG. 4 illustrates an exemplary embodiment of a pump equipped with the barrier assembly of FIG. 1 in an expanded position.

FIG. 4 shows the pump 110 after it has been set in place. In operation, the plunger 9 is lowered down into the barrel 10, which allows the spring 7 to urge the bottom adapter 6 toward the top adapter 3. This reduces the length and increases the outer diameter of the mesh sleeve 4, thereby causing the sleeve 4 to expand against the inner diameter of the tubing 11. In one embodiment, the sleeve 4 has an expanded outer diameter that is larger than the outer diameter of the barrel 10. As a result, mesh sleeve 4 forms a barrier across the annular area between the tubing 11 and the pump 110 that prevents a particulate to pass into the annular area.

FIG. 5 illustrates another embodiment of a barrier assembly 120. In this embodiment, the barrier assembly 120 is preset in the expanded position. For example, the mesh sleeve 124 is assembled onto the barrier assembly 120 and is preloaded to cause the mesh sleeve 124 to expand to a size sufficient to contact the inner diameter of the tubing 11 and form a barrier to effectively block the particulates from falling into the annular region between the tubing and the pump. As shown in FIG. 5, the barrier assembly 120 includes a top adapter 123 coupled to a bottom adapter 126 using threads 127. The mesh sleeve 124 may be disposed around the bottom adapter 126. During assembly, the top adapter 123 is threaded relative to the bottom adapter 126 to cause compression of the mesh sleeve 124. In turn, the sleeve 124 is expanded to a size sufficient to contact the inner surface of the tubing 11 and act as a barrier between the barrel 10 and the tubing 11. After assembly, the adapters 123, 126 and the mesh sleeve 124 are attached to the top of the pump barrel 10 and run into the well with the pump 110 in a manner known to a person of ordinary skill.

Figure 6:
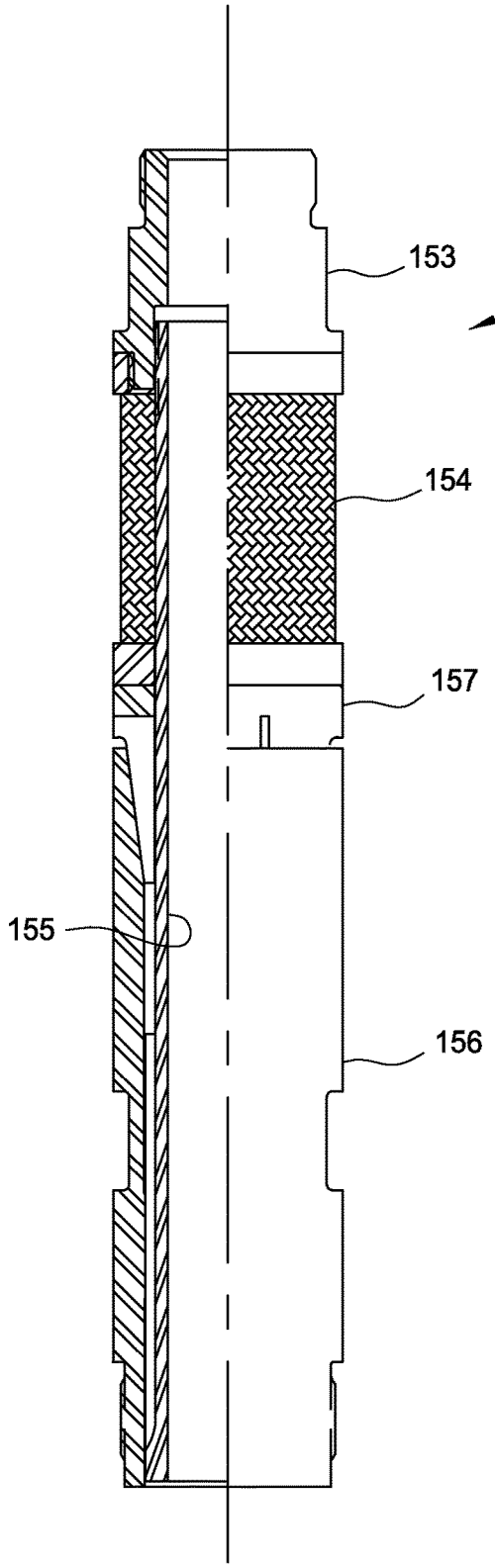
FIGS. 6 and 7 illustrate yet another embodiment of a barrier assembly in an unexpanded position and an expanded position, respectively.
Figure 7:
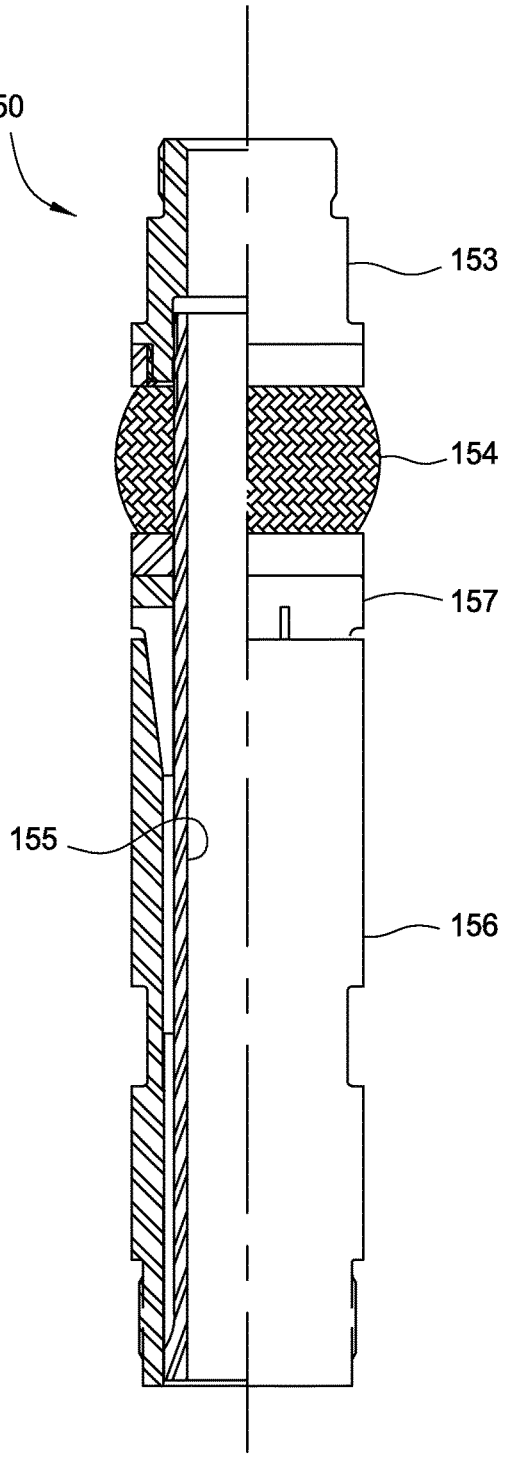

FIGS. 6 and 7 illustrate yet another embodiment of a barrier assembly 150 in an unexpanded position and an expanded position, respectively. The barrier assembly 150 includes a top adapter 153 connected to an actuating sleeve 155. A bottom adapter 156 is slidably coupled to the outer surface of the actuating sleeve 155. A mesh sleeve 154 is connected between the top adapter 153 and the bottom adapter 156. To expand the barrier assembly 150, a downward force may be applied to move the top adapter 153 toward the bottom adapter 156. The compression causes the mesh sleeve 154 to expand into contact with the tubing 11, thereby forming a barrier that will prevent particulates such as sands or solids from settling in the annular space between the tubing 11 and the pump 110. In one embodiment, a wedge member 157 may be used retain barrier assembly 150 in the expanded position. The wedge member 157 may prevent relative movement between the actuating sleeve 155 and the bottom adapter 156 after expansion. In another embodiment, the barrier assembly 150 may be expanded downhole at the same time the pump 110 is being set. During removal of the pump 110, an upward force is applied to remove the pump 110 and also release the wedge member 157, thereby allowing removal of the pump 110 and barrier assembly 150 from the well.

Figure 8:
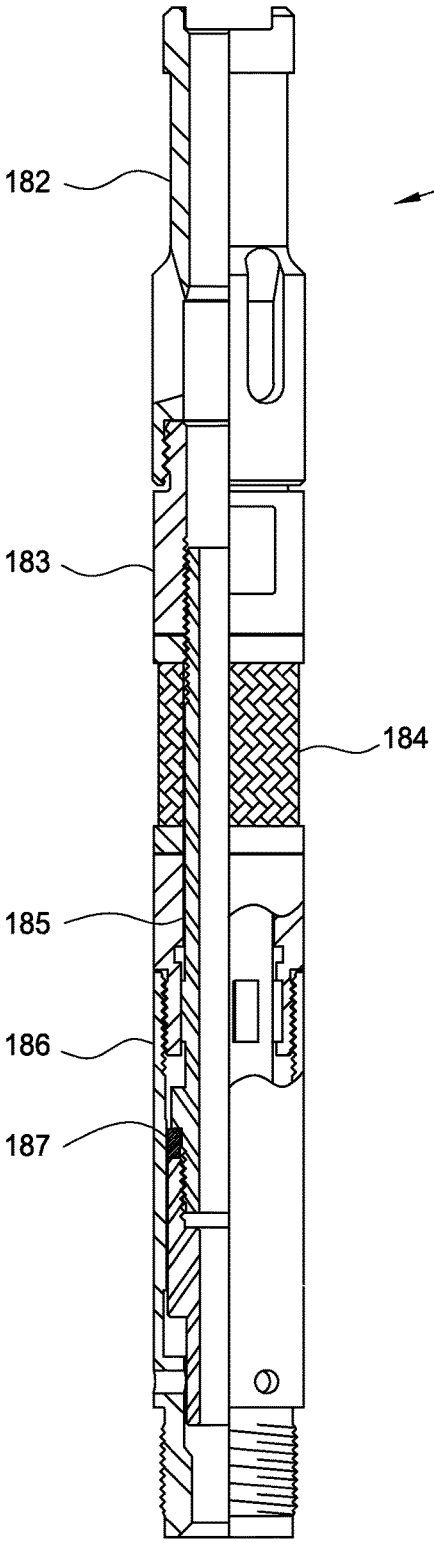
FIGS. 8 and 9 illustrate yet another embodiment of the barrier assembly 180 in an unexpanded position and an expanded position, respectively.
Figure 9:
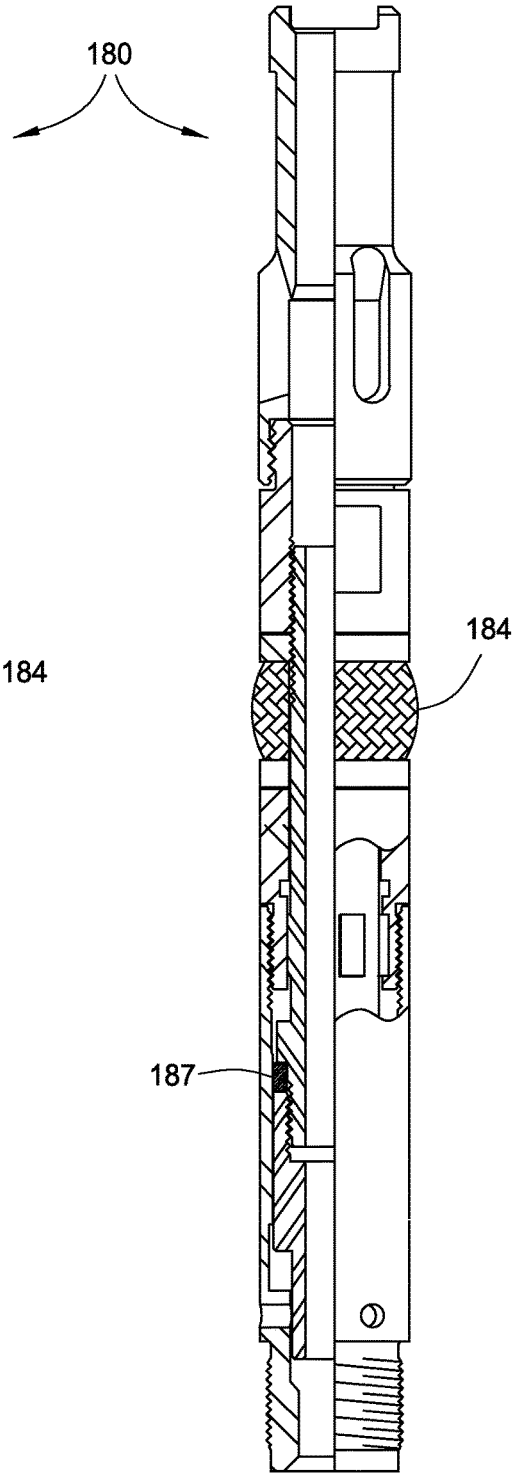

FIGS. 8 and 9 illustrate yet another embodiment of the barrier assembly 180 in an unexpanded position and an expanded position, respectively. The barrier assembly 180 includes a top adapter 183 connected to an actuating sleeve 185. The actuating sleeve 185 is slidably coupled to the inner surface of the bottom adapter 186. A friction member 187 such as a friction ring is disposed between the actuating sleeve 185 and the bottom adapter 186 to control relative movement therebetween. A mesh sleeve 184 is connected between the top adapter 183 and the bottom adapter 186. To expand the barrier assembly 180, a downward force may be applied to move the top adapter 183 toward the bottom adapter 186 and the actuating sleeve 185 relative to the bottom adapter 186. The downward force applied should be sufficient to overcome the frictional force exerted by the friction ring 187. The downward force causes the mesh sleeve 184 to expand into contact with the tubing 11, thereby forming a barrier that will prevent particulates such as sands or solids from settling in the annular space between the tubing 11 and the pump 110. FIG. 9 shows the barrier assembly 180 in the expanded position. The friction ring 187 retains the barrier assembly 180 in the expanded position. The friction ring 187 may prevent relative movement between the actuating sleeve 185 and the bottom adapter 186 after expansion. In another embodiment, the barrier assembly 180 may be expanded downhole at the same time the pump 110 is being set. During removal of the pump 110, an upward force is applied to remove the pump 110 can also release the friction ring 187, thereby allowing removal of the pump 110 and barrier assembly 180 from the well.

Figure 13:
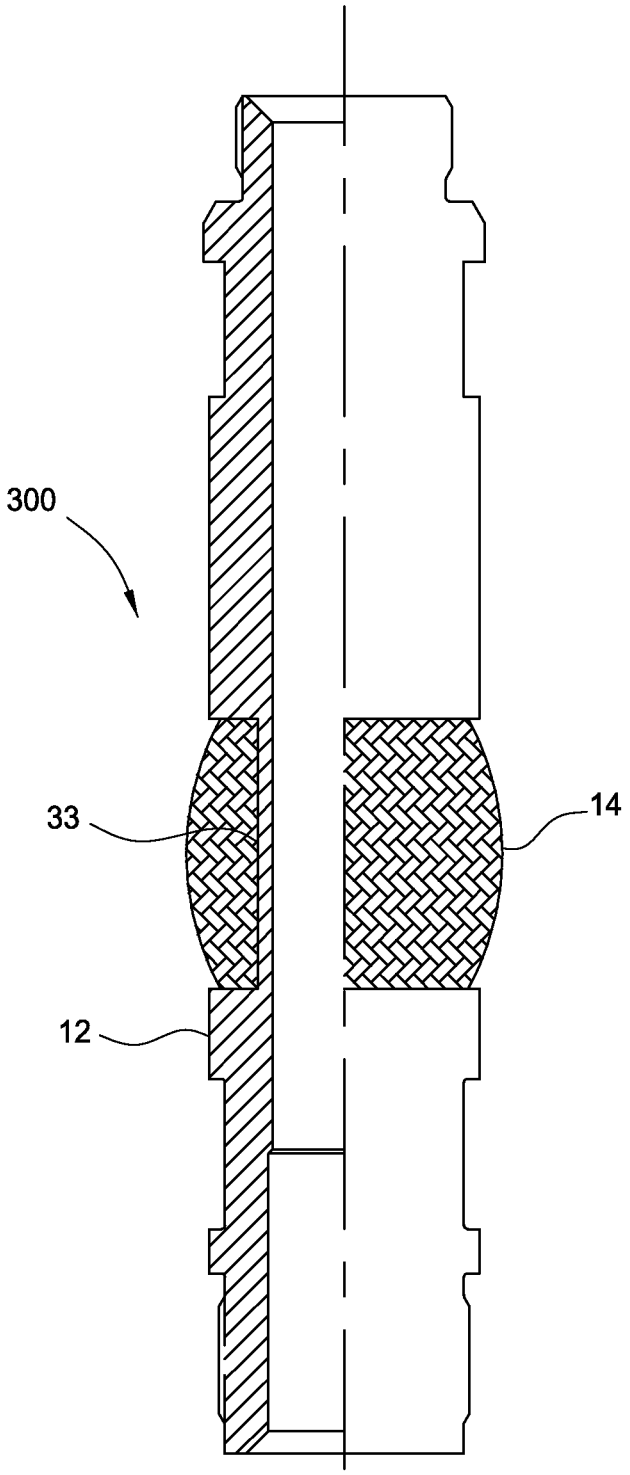
FIG. 13 illustrates another embodiment of a barrier assembly.

FIG. 13 illustrates another embodiment of a barrier assembly 300. In this embodiment, the barrier assembly 300 preset in the expanded position. For example, the mesh sleeve 14 is assembled onto a pump adapter 12 and is preloaded to cause the mesh sleeve 14 to expand to a size sufficient to contact the inner diameter of the tubing 11 and form a barrier to effectively block the particulates from falling into the annular region between the tubing and the pump. In one embodiment, the mesh sleeve 14 may be attached to a recess 33 in the pump adapter 12. The mesh sleeve 14 may be attached using a zip tie, steel band, or other suitable fasteners. After assembly, the pump adapter 12 and the mesh sleeve 14 are attached to the pump 110 and run into the well with the pump 110 in a manner known to a person of ordinary skill.

Figure 14:
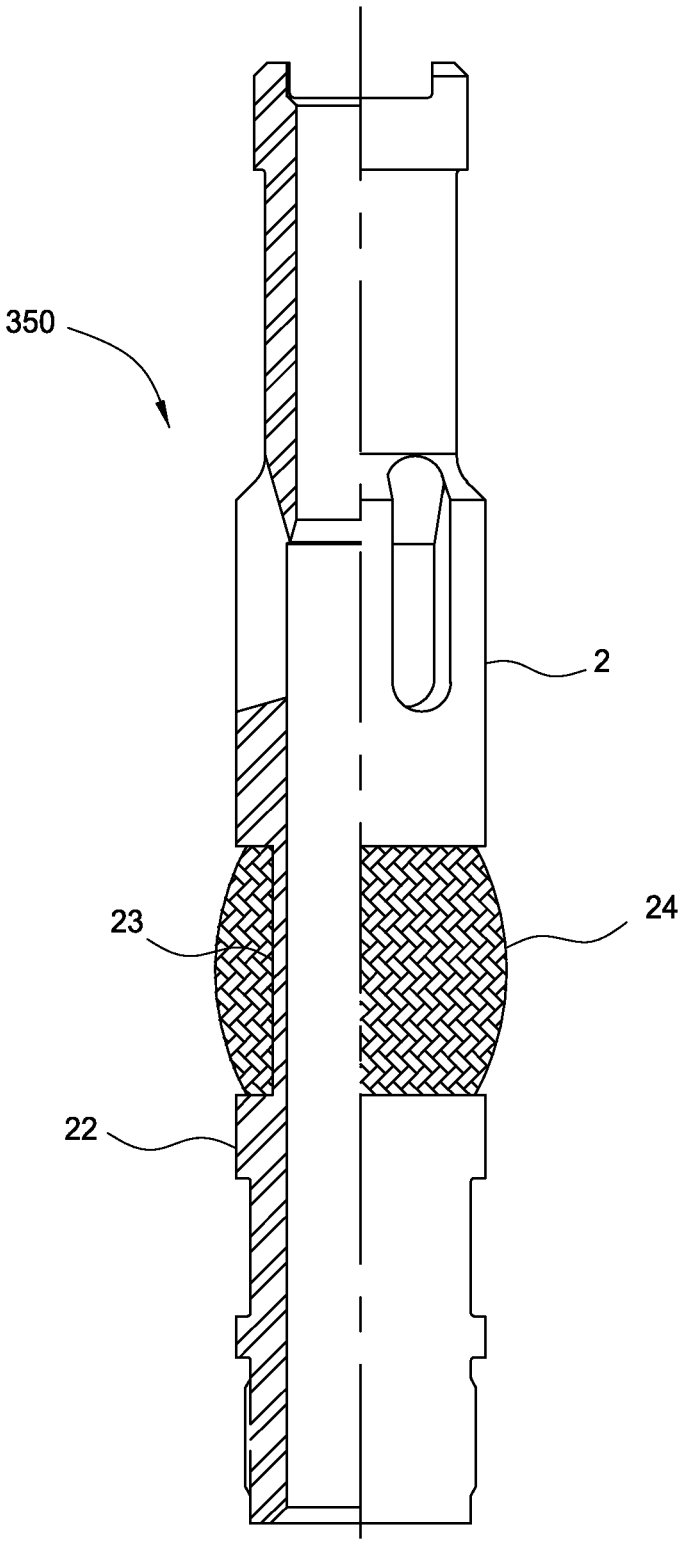
FIG. 14 illustrates another embodiment of a barrier assembly.

FIG. 14 illustrates another embodiment of a barrier assembly 350. In this embodiment, the barrier assembly 350 may be integral with the pump guide 2. For example, the mesh sleeve 24 may be assembled onto the pump guide 2 in a preset, expanded position. The mesh sleeve 24 may be preloaded to cause the mesh sleeve 24 to expand to a size sufficient to contact the inner diameter of the tubing 11 and form a barrier to effectively block the particulates from falling into the annular region between the tubing and the pump. The lower end of the pump guide 2 may include a bottom adapter 22 for connection to the pump barrel 10. In one embodiment, the mesh sleeve 24 may be attached to a recess 23 in the pump guide 2. The mesh sleeve 14 may be attached using a zip tie, steel band, or other suitable fasteners. After assembly, the pump guide 2 and the mesh sleeve 24 may be run into the well in a manner known to a person of ordinary skill.

Figure 10:
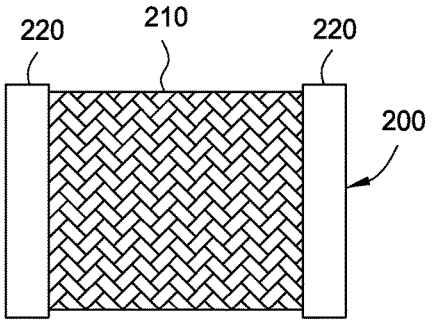
FIGS. 10 and 10A-10B show an exemplary embodiment of the mesh sleeve.
Figures 10A, 10B:
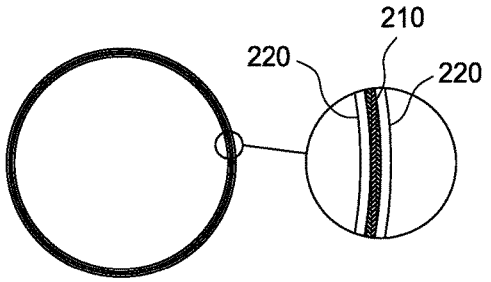
Figure 11:
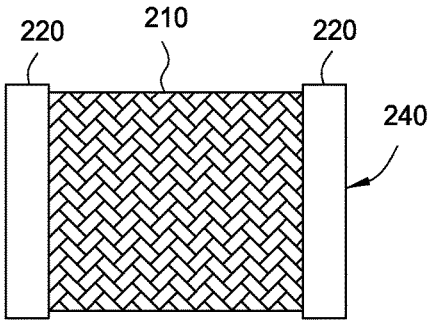
FIGS. 11 and 11A-11B show another exemplary embodiment of the mesh sleeve.
Figure 12:
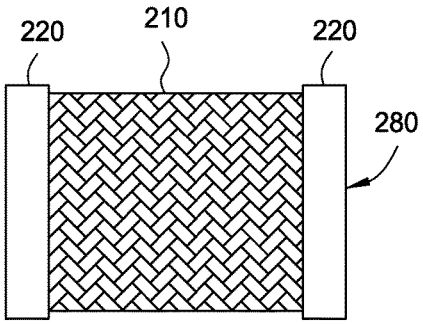
FIGS. 12 and 12A-12B show yet another exemplary embodiment of the mesh sleeve.

FIGS. 10-12 show several exemplary embodiments of the mesh sleeve 200. Referring to FIG. 10, the sleeve 200 includes a layer of braid 210 and a fastener 220 at each end. FIG. 10A is a cross-sectional of one end of the sleeve 200, and FIG. 10B is an enlarged partial view of FIG. 10A. The braid 210 includes a weave configuration formed by a plurality of weave members. Any suitable weave configuration may be used. An exemplary fastener is a ring. As shown in FIGS. 10A-B, the braid 210 is inserted between two concentric crimp rings 220 and fastened in place using a crimp tool. Other methods may be used to attach the braid to the fastener, but are not limited to, welding, gluing, melting, and combinations thereof. The crimp rings 220 can either be straight with a smooth bore, or threaded on the inner or outer diameter. In another embodiment, the fastener may be a single ring, and the braid 210 may be fastened to the inner surface or outer surface of the ring. In yet another embodiment, the mesh sleeve may be installed onto the pump using a zip tie, steel band, or other suitable fasteners.

Figures 11A, 11B:
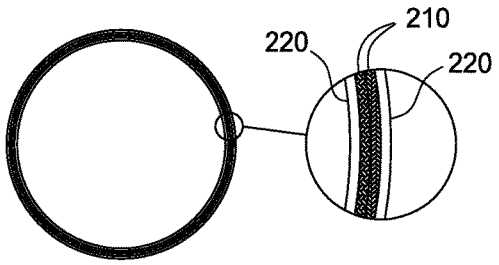

FIG. 11 illustrates another embodiment of the mesh sleeve. The sleeve 240 includes two layers of braid 210 and a fastener 220 at each end. FIG. 11A is a cross-sectional of one end of the sleeve 240, and FIG. 11B is an enlarged partial view of FIG. 11A. As shown in FIGS. 11A-B, two layers of braid 210 are inserted between two crimp rings 220 and fastened in place using a crimp tool. The double braid may allow for more filtration than the single braid shown in FIG. 10. In another embodiment, the fastener may be welded in place. The crimp rings can either be non-threaded or threaded on the inner or outer diameter. Although FIGS. 10 and 11 illustrate one and two layers of braid, it is contemplated that any suitable layers of braid may be used, for example, 3, 4, or 5 layers. In another embodiment, the fastener may be a single ring, and the braid 210 may be fastened to the inner or outer surface of the ring.

Figures 12A, 12B:
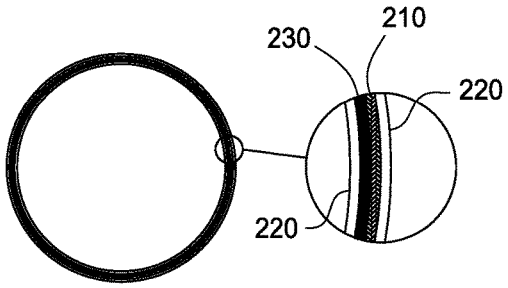

FIG. 12 illustrates another embodiment of the mesh sleeve 280. The sleeve 280 includes one or more layers of braid 210, an insert 230, and a fastener 220 at each end. FIG. 12A is a cross-sectional of one end of the sleeve 280, and FIG. 12B is an enlarged partial view of FIG. 12A. FIGS. 12A-B show an embodiment where only one layer of braid and one insert are used. It is contemplated that a plurality of braids and/or inserts may be used, such as two layer of braid and one insert or two layers of braid and two inserts. The combination of braid and insert may allow for an even greater filtration than either the single braid or double braid variations. The insert 230 may be made from any suitable material but is not limited to, foam, rubber, and combinations thereof. In another embodiment, the insert comprises a resilient material that possesses a sufficient thickness to urge the sleeve outward against the tubing wall when installed onto the pump and run into the well. In FIG. 12B, the braid 210 and insert 230 are placed between two crimp rings 220 and fastened in place using a crimp tool. In another embodiment, the fastener may be welded in place. The crimp rings can either be non-threaded or threaded on the inner diameter. In another embodiment, the fastener may be a single ring, and the braid 210 may be fastened to the inner or outer surface of the ring.

In one embodiment, a pump assembly includes a barrel; a plunger; a rod for operating the plunger; and a barrier assembly having a mesh sleeve configured to block passage of a particulate.

In another embodiment, a barrier assembly for use with a downhole pump includes a first tubular adapter; a second tubular adapter; a sleeve having a plurality of weave members and disposed between the first tubular adapter and the second tubular adapter, wherein the sleeve is configured to block passage of a particulate.

In another embodiment, a pump assembly includes a guide; a barrel; a plunger; a rod for operating the plunger; and a barrier assembly. The barrier assembly includes a top adapter attached to the guide; a bottom adapter attached to the barrel; and a mesh sleeve disposed between the top adapter and the bottom adapter, wherein the mesh sleeve is configured to block passage of a particulate.

In another embodiment, a barrier assembly includes a first tubular adapter; a second tubular adapter; and a sleeve having a plurality of weave members and is disposed between the first tubular adapter and the second tubular adapter, wherein the sleeve is expandable in response to a compressive force.

In one or more of the embodiments described herein, the mesh sleeve comprises a plurality of weave members configured to block passage of a particulate.

In one or more of the embodiments described herein, the mesh sleeve is expandable.

In one or more of the embodiments described herein, the mesh sleeve allows fluid communication.

In one or more of the embodiments described herein, the sleeve is extendable in response to tension.

In one or more of the embodiments described herein, the sleeve is expandable in response to compression.

In one or more of the embodiments described herein, the sleeve is configured to seal against fluid flow.

In one or more of the embodiments described herein, the sleeve comprises at least one layer of braid and a fastener at each end.

In one or more of the embodiments described herein, the fastener comprises a crimp ring.

In one or more of the embodiments described herein, the sleeve further comprises an insert having a material selected from the group consisting of foam, rubber, and combinations thereof.

In one or more of the embodiments described herein, the weave members are in a braided configuration.

In one or more of the embodiments described herein, the weave members are in a knitted configuration.

In one or more of the embodiments described herein, the barrier assembly includes an actuating sleeve attached to the first tubular adapter, and wherein the second tubular adapter is movable along the actuating sleeve.

In one or more of the embodiments described herein, the barrier assembly includes a biasing member for biasing the second tubular adapter.

In one or more of the embodiments described herein, the barrier assembly includes a wedge member for retaining the sleeve in an expanded position.

In one or more of the embodiments described herein, the barrier assembly includes a friction member for retaining the sleeve in an expanded position.

In one or more of the embodiments described herein, the mesh sleeve comprises a braided sleeve.

In one or more of the embodiments described herein, the mesh sleeve is expanded when a compressive force is applied.

While the foregoing is directed to embodiments of the present invention, other and further embodiments of the invention may be devised without departing from the basic scope thereof, and the scope thereof is determined by the claims that follow.

The invention claimed is:

1. A pump assembly, comprising:

a barrel;

a plunger;

a rod for operating the plunger; and a barrier assembly adjustable between an expanded position and an unexpanded position, the barrier assembly having a mesh sleeve configured to block passage of a particulate from an annular area above the mesh sleeve to an annular area below the mesh sleeve when the barrier assembly is in the expanded position, wherein the mesh sleeve is configured to allow fluid communication when in the expanded position.

2. The pump assembly of claim 1, wherein the mesh sleeve comprises a plurality of weave members configured to block passage of the particulate when the mesh sleeve is in the expanded position.

3. The pump of claim 1, wherein the barrier assembly has a first, longer axial length in a first position and a second, shorter axial length in a second position and wherein the sleeve has a larger outer diameter in the second position.

4. The pump assembly of claim 3, wherein an outer diameter of the mesh sleeve is enlarged as the barrier assembly moves from the first to the second position.

5. A barrier assembly for use with a downhole pump, comprising:

a first tubular adapter;

a second tubular adapter;

a sleeve having a plurality of weave members and disposed between the first tubular adapter and the second tubular adapter, the sleeve being changeable between a larger outer diameter and a smaller outer diameter, wherein the sleeve is weave members are configured to block passage of a particulate while allowing fluid communication when the sleeve has the larger outer diameter.

6. The barrier assembly of claim 5, wherein the length of the sleeve is extendable in response to tension.

7. The barrier assembly of claim 5, wherein the outer diameter of the sleeve is expandable in response to compression.

8. The barrier assembly of claim 5, wherein the sleeve comprises at least one layer of braid and a fastener at each end.

9. The barrier assembly of claim 8, wherein the fastener comprises a crimp ring.

10. The barrier assembly of claim 8, wherein the sleeve further comprises an insert having a material selected from the group consisting of foam, rubber, and combinations thereof.

11. The barrier assembly of claim 5, wherein the weave members are in a braided configuration.

12. The barrier assembly of claim 5, wherein the weave members are in a knitted configuration.

13. The barrier assembly of claim 5, further comprising an actuating sleeve attached to the first tubular adapter, and wherein the second tubular adapter is movable along the actuating sleeve.

14. The barrier assembly of claim 13, further comprising a biasing member for biasing the second tubular adapter.

15. The barrier assembly of claim 13, further comprising a wedge member for retaining the sleeve in an expanded position.

16. The barrier assembly of claim 13, further comprising a friction member for retaining the sleeve in an expanded position.

17. A pump assembly, comprising:

a guide;

a barrel;

a plunger;

a rod for operating the plunger; and a barrier assembly having:

a top adapter attached to the guide;

a bottom adapter attached to the barrel, the top and bottom adapters axially seperatable between a first position in which the adapters abut one another and a second position wherein a gap separates the adapters; and a mesh sleeve configured to block passage of a particulate, the sleeve disposed between the top adapter and the bottom adapter and configured to assume a first outer diameter in the first position and a second, larger diameter in the second position.

18. The pump assembly of claim 17, further including a sleeve, the sleeve disposed along an inner diameter of the adapters and constructed and arranged to isolate an interior of the barrier assembly from an exterior thereof when the adapters are in the second position.

19. The pump assembly of claim 18, further including a biasing member constructed and arranged to urge the adapters to the first position.

20. A barrier assembly, comprising:

a first tubular adapter;

a second tubular adapter; and a plurality of weave members forming a sleeve, the plurality of weave members configured such that the sleeve is adjustable between an expanded position and an unexpanded position, the sleeve being connected to the first tubular adapter and the second tubular adapter when the sleeve is in the expanded position and when the sleeve is in the unexpanded position, the weave members being constructed and arranged to isolate an interior of the sleeve from an exterior thereof when the sleeve is in the expanded position, the weave members being configured to contact a tubing string in a well and block passage of a particulate when the sleeve is in the expanded position.

* * * * *